US005785065A

United States Patent [19]

Johnson

[11] Patent Number: 5,785,065

[45] **Date of Patent: *Jul. 28, 1998**

[54] HAIR BARRETTE WITH REPLACEABLE ORNAMENTS

[76] Inventor: Destrina D. Johnson, 630-½ S. Broadway Apt.#1 , Menomonie, Wis. 54751

[ * ] Notice: The term of this patent shall not extend beyond the expiration date of Pat. No. 5,573,018.

[21] Appl. No.: 684,893

[22] Filed: Jul. 25, 1996

Related U.S. Application Data

[63] Continuation-in-part of Ser. No. 510,746, Aug. 3, 1995, Pat. No. 5,573,018.

[51] Int. Cl.[6] ..... A45D 8/12

[52] U.S. Cl. ..... 132/275; 132/273; 132/276; 132/278

[58] Field of Search ..... 132/273, 275, 132/276, 278; 411/338, 339, 588, 509, 913; 63/29.1, 2

[56] References Cited

U.S. PATENT DOCUMENTS

| | | | |
|---|---|---|---|
| 401,649 | 4/1889 | Hackett . | |
| 887,149 | 5/1908 | Tarnow . | |
| 921,702 | 5/1909 | Howe . | |
| 1,221,172 | 4/1917 | Hamilton | 132/275 |
| 1,552,147 | 9/1925 | Hall . | |
| 2,169,596 | 8/1939 | Solomon | 132/275 |
| 2,316,225 | 4/1943 | Hoffman et al. | 63/29 |
| 2,660,826 | 12/1953 | Bennett | 132/275 |
| 3,192,932 | 7/1965 | Hart | 132/275 |
| 3,441,032 | 4/1969 | Barrett | 132/46 |
| 3,633,592 | 1/1972 | Buglio et al. | 132/48 |
| 3,921,496 | 11/1975 | Helderman | 85/83 |
| 5,000,637 | 3/1991 | Adams | 411/339 |
| 5,355,698 | 10/1994 | Edmark | 63/29.1 |
| 5,441,061 | 8/1995 | Jordan et al. | 132/275 |

FOREIGN PATENT DOCUMENTS

| | | | |
|---|---|---|---|
| 537622 | 3/1922 | France | 132/275 |
| 570207 | 4/1924 | France | 132/275 |
| 2174001 | 10/1986 | United Kingdom | 132/275 |

OTHER PUBLICATIONS

U.S. Patent Appliction Serial No. 08/510,746, filed Aug. 3, 1995 by Destrina D. Johnson, entitled Improved Hair Barrette with Replaceable Ornaments (status—pending); Group Art Unit: 3303; Examiner P. Philogene.

U.S. Patent Application Serial No. 08/285,940, filed Aug. 4, 1994 by Destrina D. Johnson, entitled Ornamental Hair Barrette Incorporating Replaceable Ornaments (status—abondoned); Group Art Unit: 3303; Examiner T. Manahan.

*Primary Examiner*—Gene Mancene
*Assistant Examiner*—Pedro Philogene

[57] ABSTRACT

A hair barrette includes a reversible snap-on connecting device for attaching, replacing and/or adding one or more ornamental appendages to a hair clamp. The novel connecting device is structurally capable of rapidly, repetitively and selectively performing the attaching, replacing and/or adding functions substantially in perpetuity without suffering material fatigue and/or functional failure of the connecting device.

12 Claims, 9 Drawing Sheets

HAIR BARRETTE WITH REPLACEABLE ORNAMENTS

This Application is a Continuation in Part of co-pending U.S. patent application Ser. No. 08/510,746, filed Aug. 3, 1995, by the present inventor, and entitled Improved Hair Barrette With Replaceable Ornaments now U.S. Pat. No. 5,573,018.

BACKGROUND OF THE INVENTION

1. Field of the Invention

The present invention relates to a barrette and, more particularly, a barrette having compressible fabric ornamental appendages which are easily and quickly removed and replaced.

2. Description of the Prior Art

Hair barrettes or hair clamping devices have been utilized for a long period of time as exemplified by U.S. Pat. No. 921,702, issued to Howe on May 18, 1909. As shown by Howe, barrettes typically include a curved metal strip having a wire clamp or pin that closes about the user's hair to maintain the hair in place.

It is also common custom for people to adorn themselves with ornamental structures such as ribbons or broaches. In U.S. Pat. No. 887,149, issued to Tarnow on May 12, 1908, there is disclosed a fastening device for securing bows in a person's hair.

Conventional barrettes usually comprise an arcuate clip which carries an assembly of pivotal bars and locking elements for the actual clamping of a tress of hair, and an arcuate, usually broader, plastic holder or metal bar to which the clip is attached. Together, the plastic holder or metal bar so coupled to an arcuate clip may be referred to as a hair clamp. The outer side of the holder can be decorated or adorned with various ornamental appendages such as jewelry, lace and the like. However, one of the most limiting features of early barrettes such as Tarnow's is that, if a person wearing a barrette desired a change of the barrette's appearance, she would need to remove the entire barrette from her hair and replace it with another barrette having different ornamental features.

Barrettes further evolved with replaceable ornamental features through the teachings such as U.S. Pat. No. 5,355,698, issued to Edmark on Oct. 18, 1994, U.S. Pat. No. 3,192,932, issued to Hart on Jul. 6, 1965, and U.K. Pat. No. 2,174,001, issued to Pabari on Apr. 19, 1985. Through these inventions, features such as ribbons, flowers, bows and the like can be removed and inserted into the barrette, thereby providing an economical means of enjoying a variety of styles and ornaments together with one basic barrette.

The designs of Hart, Pabari and Edmark, however, have their limitations. Hart discloses a barrette with ornamental member, male and female snap members, and a plurality of tabs and notches which are designed to secure the ornamental member, through the snap members, to the hair clamp. Hart's teaching requires several elements, including arrays of tabs and notches, elements which contribute to the cost of manufacturing. The connecting means of Pabari's teaching requires the use of female and male spigots which must be removed and reset each time the ornamental member is replaced. One of the Pabari spigots must be placed underneath the body member of the barrette in order to receive its mate spigot (male or female) which, thereby, secures the ornamental piece from above. This limitation requires the Pabari barrette to be removed from the wearer's hair each time the ornamental member is to be replaced. Yet another limitation of the Hart, Pabari and Edmark designs is that wearers may desire to wear several ornamental members simultaneously, mixing and matching a number of ornaments together, thereby achieving a multiplicity of styles and appearances at an economical price, yet this objective is not achievable in the design of Hart and not easily achievable through the teaching of Pabari or Edmark. Furthermore, another limitation of the aforesaid designs is that the wearer may desire the body of the barrette to be concealed completely by its ornaments while the barrette is worn, a feature not completely accomplished by the designs of Hart and Pabari due to the complexities of their coupling means. Hart, for example, discloses a coupling mechanism which protrudes outward from the body of the barrette and a decorative piece which, when coupled to the body, is further extended from the body of the barrette by the length of the coupling means.

The '698 patent issued to Edmark teaches the use of interchangeable ornaments for non-barrette hair pieces. Edmark discloses the combination of a setting which includes a frame and a base, at least one interchangeable, decorative piece, and a coupling means for coupling a single decorative piece to the setting. Whereas Edmark discloses designs for economical, replaceable ornamental appendages, this teaching falls short of combining these features together with the highly desirable hair grooming attributes of a barrette. Also, the frame element of Edmark confines the sizes and shapes of replaceable decorative pieces to the sizes and shapes of the frame.

While a barrette is an inexpensive item, the creation of a barrette having a flexible design for an economical price is a challenge which manufacturers face regularly. A disadvantage of known barrette designs is that to acquire a broad variety of color coordinates, including the casual as well as formal, together with a variety of shapes and sizes, so that a person can enhance their wardrobe at an economical price is typically achieved by purchasing numerous barrettes, each having a single color and ornamental design. Although a single barrette may be an inexpensive item, purchasing several barrettes can be costly, particularly for those on lower clothing budgets. These limitations are problematic both for manufacturers and the barrette wearing public, yet they are all overcome by the innovations disclosed herein.

SUMMARY OF THE INVENTION

The present invention overcomes the disadvantages of known ornamental hair barrettes by providing a barrette having a mechanism allowing for replacement, removal and/or addition of alternate ornamental appendages, either individually or simultaneously, and amenable to rapid and economic assembly while providing ample securement of the ornamental appendages.

Another feature of the present invention is the provision of an ornamental barrette which offers the consumer a broad variety of ornamental designs and color coordinates, casual as well as formal, at an economical price.

Another feature of the present invention is the unique design of the coupling means which, together with other inventive features, makes it possible for the barrette to receive, replace, and/or add, either a single ornamental appendage, or several ornamental appendages simultaneously without requiring the wearer to remove the barrette from the wearer's hair during the aforesaid process. This feature enables the wearer to mix and match her complement of ornaments in a multiplicity of combinations, thereby providing the wearer having a relatively few number of ornaments a greater range of looks and appearances from which the wearer can choose.

Yet another feature makes it possible for one or more ornamental appendages, by their size, to completely conceal the body of the hair clamp when the barrette is worn.

Furthermore, another feature makes it possible for one or more ornamental appendages to be recessed, through a stem which is attached to the hair clamp, whereby the ornamental appendages are not extended from the hair clamp as taught by the prior art, but capable of being placed adjacent to the hair clamp, a feature which further conceals the hair clamp and thereby results in a more attractive appearance.

The most preferred embodiment for the present inventive barrette incorporates a stem assembly permanently attached to a hair clamp. An ornamental knob adapted to engage the stem assembly through an innovative coupling means can be used alone as an ornament or in conjunction with one or more ornamental appendages such as lace, bows and the like.

BRIEF DESCRIPTION OF THE DRAWINGS

Other characteristics and features of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
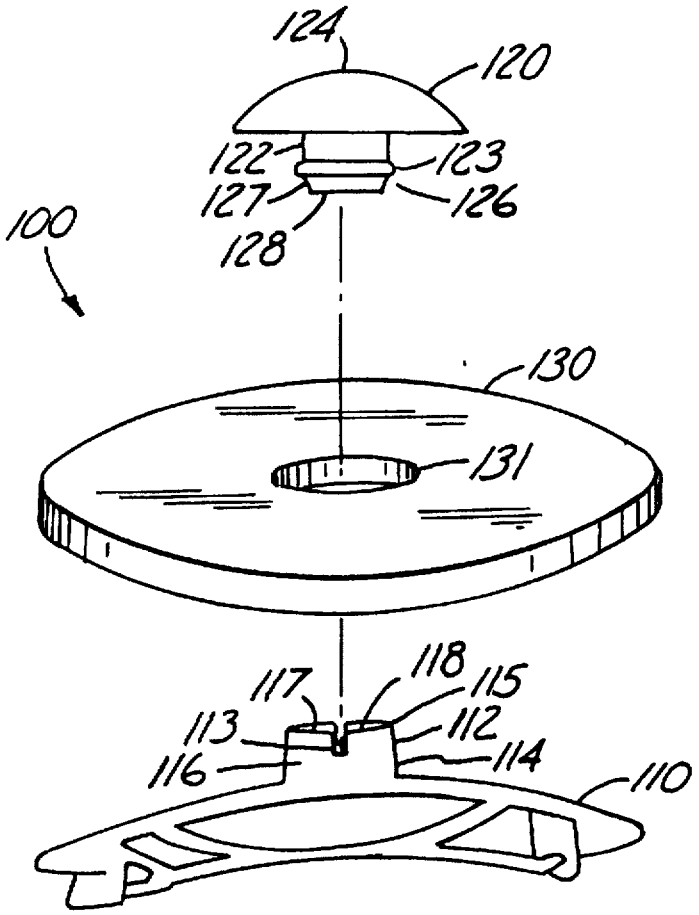
FIG. 1 illustrates one preferred embodiment of a hair barrette having replaceable ornamental appendages in exploded view, showing a stem assembly attached to a hair clamp or similar device, a replaceable ornamental piece, and an ornamental button assembly being receivably coupled to the stem assembly.

The present invention will now be more fully described with reference to the various Figures of the drawings, FIG. 1 illustrating one preferred embodiment 100 for the present inventive barrette including a hair clamp 110 and a stem assembly 112 attached to the hair clamp 110. In embodiment 100, stem assembly 112 preferably includes at least one slot, and most preferably a plurality of slots 113. Hair clamp 110 and stem assembly 112 may be made from metallic material which may then be coupled together by welding, for example. The present invention is not so limited however, and those skilled in the art will recognize that the portion of hair clamp 110 to which stem assembly 112 is attached, could also be made from other materials such as plastic for example, which could then be secured to hair clamp 110 by alternate means such as cementing or gluing. Most preferably, stem assembly 112 and hair clamp 110 are formed of a single unitary piece part made by a plastic injection molding process, for example. Alternatively, stem assembly 112 and hair clamp 110 could be joined, for example, by some sort of a combination of a friction-fit or non-reversible snap-on connecting means as is known to those skilled in the art. Less preferable connecting means may include, for example, a slide-on or magnetic devices. Preferably, stem assembly 112 includes at least one slot 113 and most preferably a plurality of slots 113 extending substantially lengthwise and axially along the stem assembly 112. Stem assembly 112 also has a first end 114, a second end 115, a first outer surface 116, a first inner surface 117, and one or more recesses 118 within the first inner surface 117.

Looking again at FIG. 1, there is illustrated one embodiment of an ornamental button assembly 120 having an ornamental head 124 and a shaft 122 for removably engaging the stem 112. Ornamental button assembly 120 may vary in size, shape, color and material. In the preferred embodiment 100, ornamental head 124 is shown to have a diameter substantially larger than the diameter of the shaft 122. Preferably, one or more ribs 123 which form a portion of the connecting means 126, are attached to the outer surface 127 of the shaft 122. It will be appreciated that shaft 122 may include an inner surface 128 for ease of manufacture. Ribs 123 are sized such that the connecting means 126 has an outer diameter that is slightly larger than the diameter formed by the first inner surface 117 of the stem assembly 112, yet capable of being securely received within any of several recesses 118 of the first inner surface 117 of the stem assembly 112. This approach gives a single barrette the flexibility to receive any combination of one, two, or more ornamental appendages 130, whereas the stem assembly 112 and ornamental button assembly 120 are just as securely coupled with three ornamental appendages 130 installed as they are with a single ornamental appendage 130. For example, the connecting means 126 allows for rapidly and selectively performing at least one of replacing and adding, at least one ornamental appendage 130 to the inventive hair clamp 110 even when the one or more ornamental appendages 130 are compressed and exerting forces which are likely to separate normal friction type connecting mechanisms, such as disclosed by Edmark referenced hereinbefore. Although the ornamental button assembly 120 illustrated in FIG. 1 depicts a ribbed shaft 122 for removably coupling the ornamental button assembly 120 to the stem assembly 112, the present invention is not so limited. For example, shaft 122 could easily be replaced with a less preferable friction type fitting well known to those skilled in the art of friction fittings, which could then be coupled to the stem assembly 112 by urging the button 120 and the stem assembly 112 together. However, such a friction type fitting is amenable to coupling failure with time, due to material fatigue, and particularly due to expansion forces resulting from compressing puffy-type ornamental appendages between the ornamental head 124 and the body of the barrette 110, as described hereinbefore.

When the stem assembly 112 and ornamental button assembly 120 of FIG. 1 are in the process of being coupled, one or more slots 113 of the stem assembly 112 allow the second end 115 of the stem assembly 112 to expand slightly. Once the stem assembly 112 and ornamental button assembly 120 are properly coupled, the connecting means 126 of the shaft 122 is securely received within one or more of the recesses 118 of the first inner surface 117 of the stem assembly 112, and the second end 115 of the stem assembly 112 automatically retracts to its normal, unexpanded form.

Figure 2:
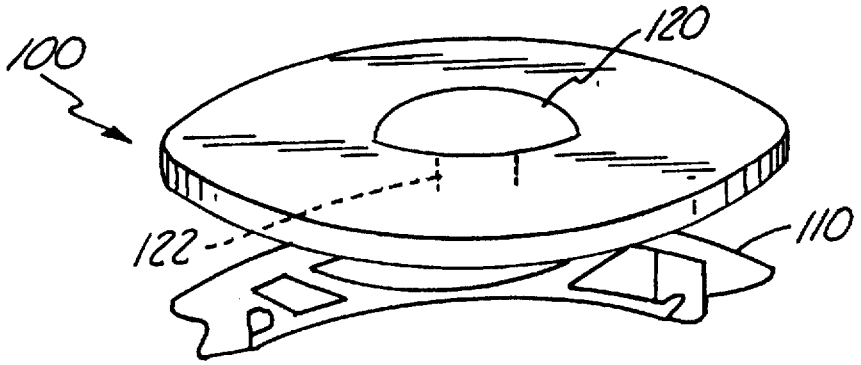
FIG. 2 illustrates the embodiment of FIG. 1 in unexploded view.

It can be seen from FIGS. 1 and 2 that an ornamental barrette 100 can be formed with ornamental button assembly 120 affixed to stem assembly 112 and hair clamp 110 without the addition of one or more ornamental appendages such as bows, ribbons and the like.

Figure 3:
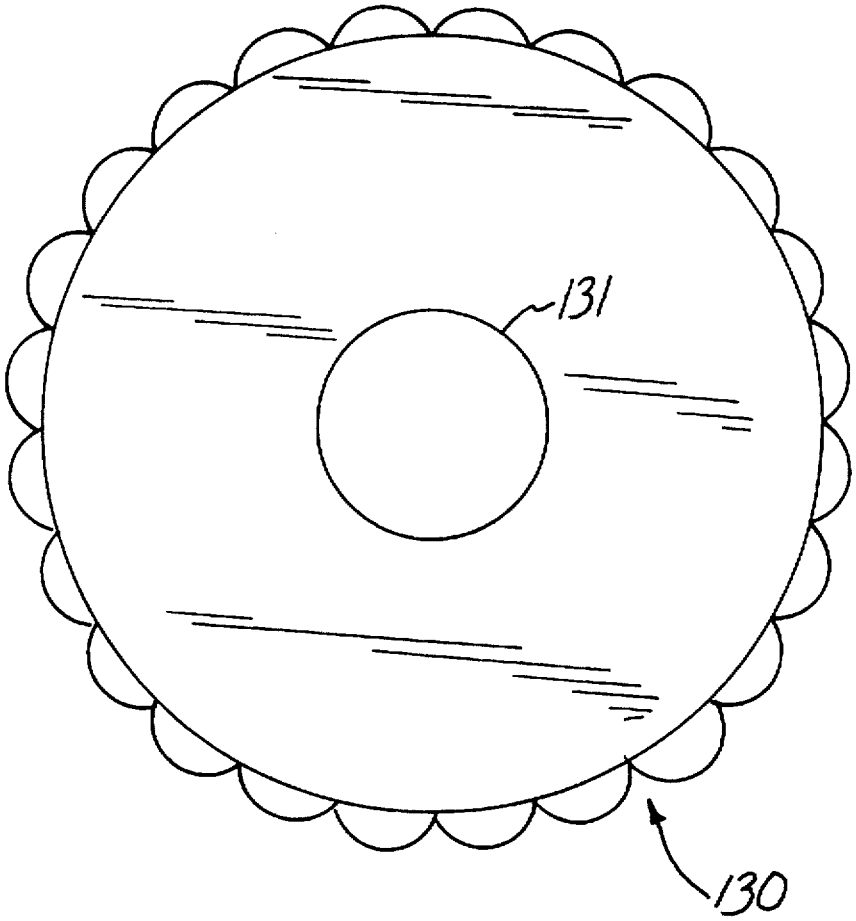
FIG. 3 illustrates a top view of the hair barrette for the embodiment shown in FIG. 1.

Referring to FIG. 3, a top view of a representative ornamental piece 130 is shown. Ornamental pieces 130 can be made from many different materials, including fabrics such as cotton, linen, and silk, and further including plastics and metals. Also, ornamental pieces 130 can be made into a variety of sizes and shapes at the pleasure of the designers and the barrette-wearing consumers. In the preferred embodiment, the ornamental piece 130 has an opening 131 which is ideally but not necessarily placed at the center of the ornamental piece 130. The opening 131 is of sufficient size to be removably received by the stem assembly 112 of the hair clamp 110, but smaller than the diameter of the ornamental head 124 of the ornamental button assembly 120.

Figure 4:
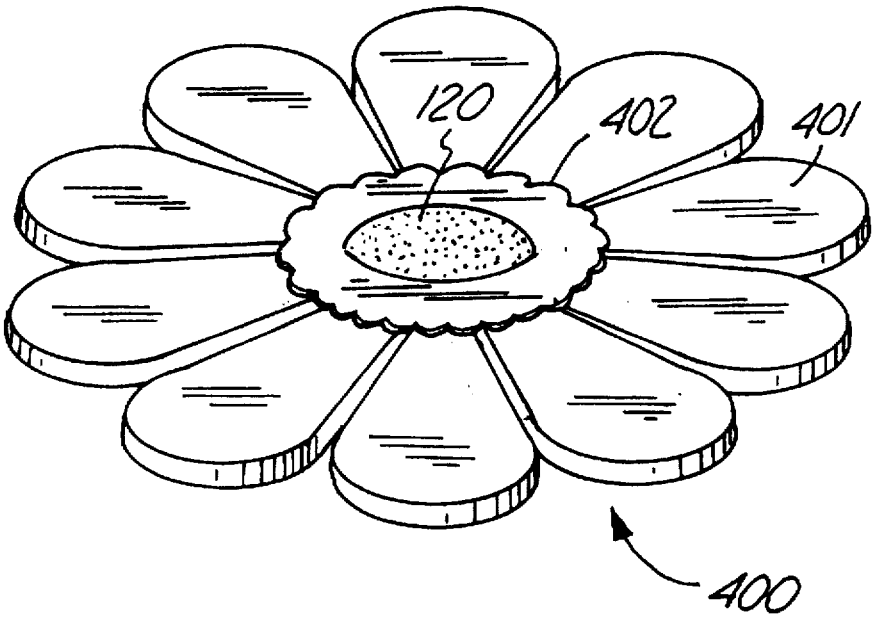
FIG. 4 illustrates a plurality of ornamental appendages coupled to a stem assembly with the rapid disconnect ornamental button assembly as shown in FIG. 1.

Referring to FIG. 4, a perspective view is illustrated for yet another embodiment 400 of the present inventive barrette. Here, two ornamental appendages 401, 402 are receivably coupled to the stem assembly 112 of the hair clamp 100, and secured by the proper coupling of the ornamental button 124 to the stem assembly 112. Specific ornamental appendages having compression and expansion characteristics due to material hysteresis are capable of exerting forces sufficient to separate the ornamental button 124 from the stem assembly 112 in the absence of secure coupling. As stated hereinbefore, a friction type coupling mechanism taught by Edmark is likely to weaken with continued use due to material fatigue, thereby rendering such friction type coupling mechanisms undesirable for high volume, repetitive use, such as that anticipated by the inventors of the present invention. The coupling mechanisms taught by Pabari operate to effectively eliminate coupling mechanism failures due to undesirable material fatigue. However, the coupling mechanisms taught by Pabari are either permanent or semi-permanent type coupling mechanisms which are not intended to be either removed entirely, i.e. irreversible or otherwise be rapidly removed and/or replaced. The present invention solves these aforesaid limitations by providing a coupling mechanism 126 which substantially eliminates coupling mechanism failures due to undesirable material fatigue, while simultaneously selectively achieving short or long term secure attachment of ornamental appendages 130, 401, 402 to a barrette 110 or other similar grooming device. The present inventive coupling mechanism 126 is capable of being selectively and rapidly removed and/or replaced reliably during a wearer's lifetime to receive, replace and/or add one or more ornamental appendages 130, 401, 402. As stated hereinbefore, the aforesaid is achieved without requiring the wearer to remove the wearer's barrette from the wearer's hair while the ornamental appendages 130, 401, 402 are being received, replaced and/or added, and without eventual breakdown and failure of the coupling mechanism 126.

Figure 5:
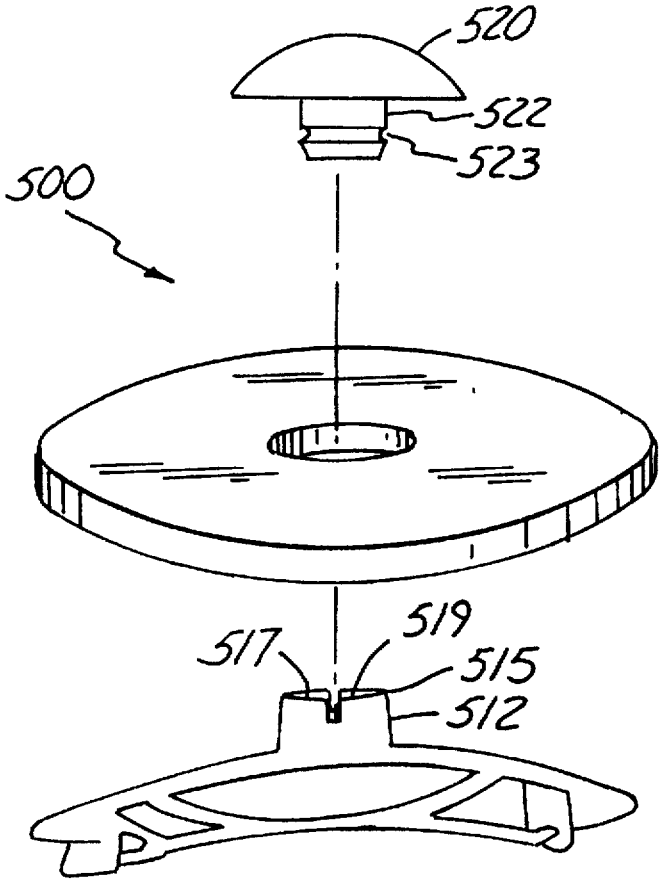
FIG. 5 shows an alternate embodiment illustrating an ornamental appendage which may be securely attached to a hair barrette or similar device with an ornamental rapid disconnect securing assembly, similar to FIG. 1.

FIG. 5 illustrates another embodiment 500 of the inventive barrette which includes a variation of the connecting means 126 and stem assembly 112 depicted in FIG. 1 heretofore described. Looking now at FIG. 5, one or more ribs 519 are placed within the inner surface 517 substantially toward a selected end 515 of the stem assembly 512. In like manner, shaft 522 of the ornamental button assembly 520 has one or more corresponding recesses 523. All remaining elements are identical to those described in FIG. 1. It is clear, with exception of the placement of the ribs 519 and recesses 523, the barrette of FIG. 5 is a functional equivalent of the barrette of FIG. 1.

The embodiments shown in FIGS. 1 through 5 are intended to illustrative and the present invention is not so limited. For example, any number or ornamental appendages including ribbons, bows, squishies and the like may be received by the stem assembly 112, 512 and secured in place with ornamental button assembly 120, 520. In this way, a broad variety of color coordinates quickly become available, both casual and formal, and at an economical price.

Figure 6:
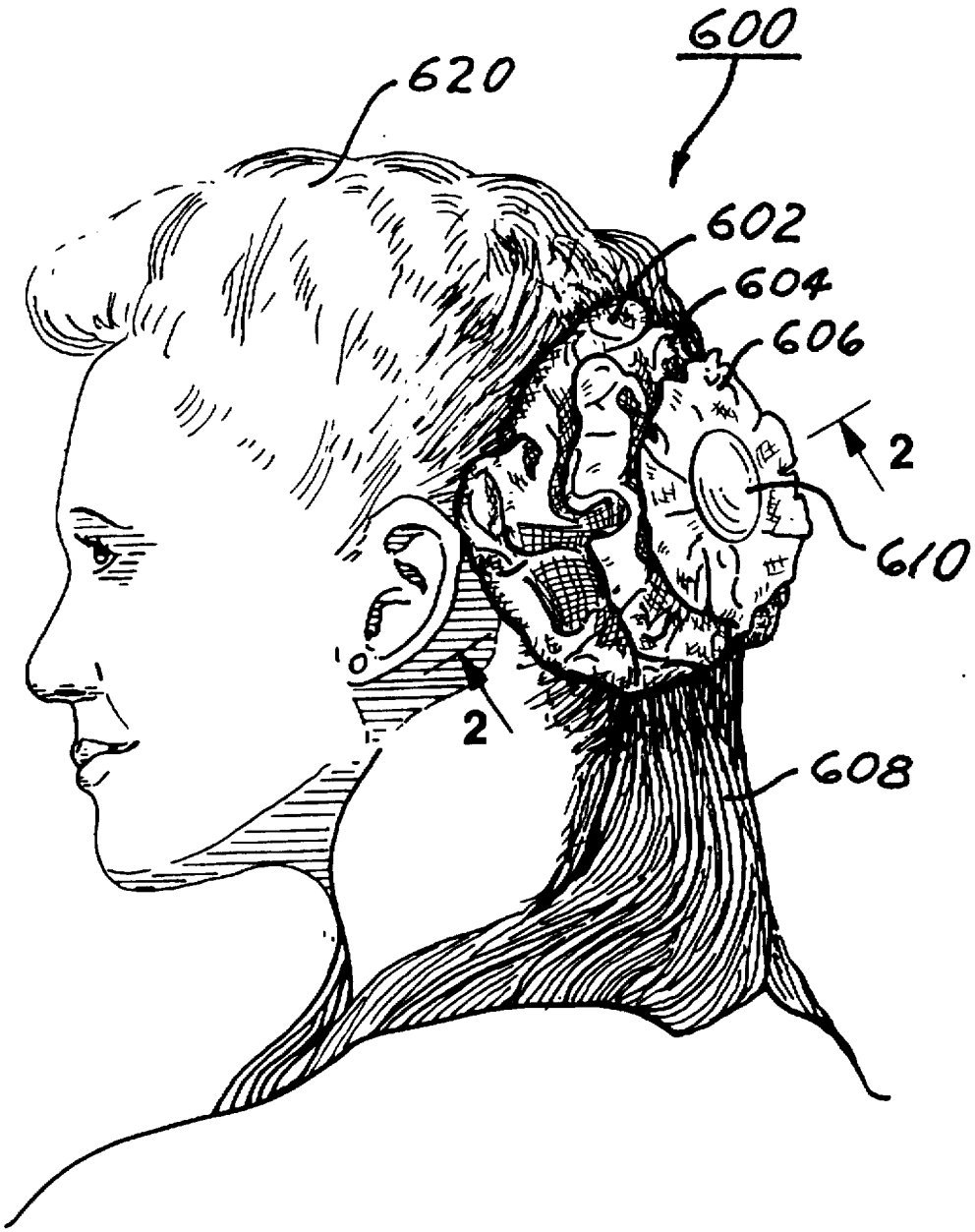
FIG. 6 is a perspective view illustrating another preferred embodiment for a hair barrette assembly having replaceable ornaments which is attached to a wearer's truss of hair.

Referring now to FIG. 6, a perspective view is shown for a preferred embodiment for a hair barrette assembly 600 having replaceable ornamental appendages 602, 604, 606, and which is attached to a wearer's 620 truss of hair 608. The ornamental appendages 602, 604, 606 are removably, but securely attached to the hair truss 608 via an ornamental button assembly 120, which is designed to be removably coupled to the barrette (shown as 110 in FIG. 1) in a manner such as that shown in FIGS. 1 and 6. It can be seen that the wearer 620 can easily remove the ornamental button assembly 120 from the barrette assembly 600 without removing the hair barrette 110 from the truss of hair 608, thereby allowing the wearer 620 to selectively remove, replace, or add additional ornamental appendages to the barrette assembly 600. Once ornamental appendages 602, 604, 606 have been selectively removed, replaced or added to, the ornamental button assembly 120 can then be securely re-attached to the hair barrette 110 to securely couple the newly selected ornamental appendages to the hair truss 608.

Figure 7:
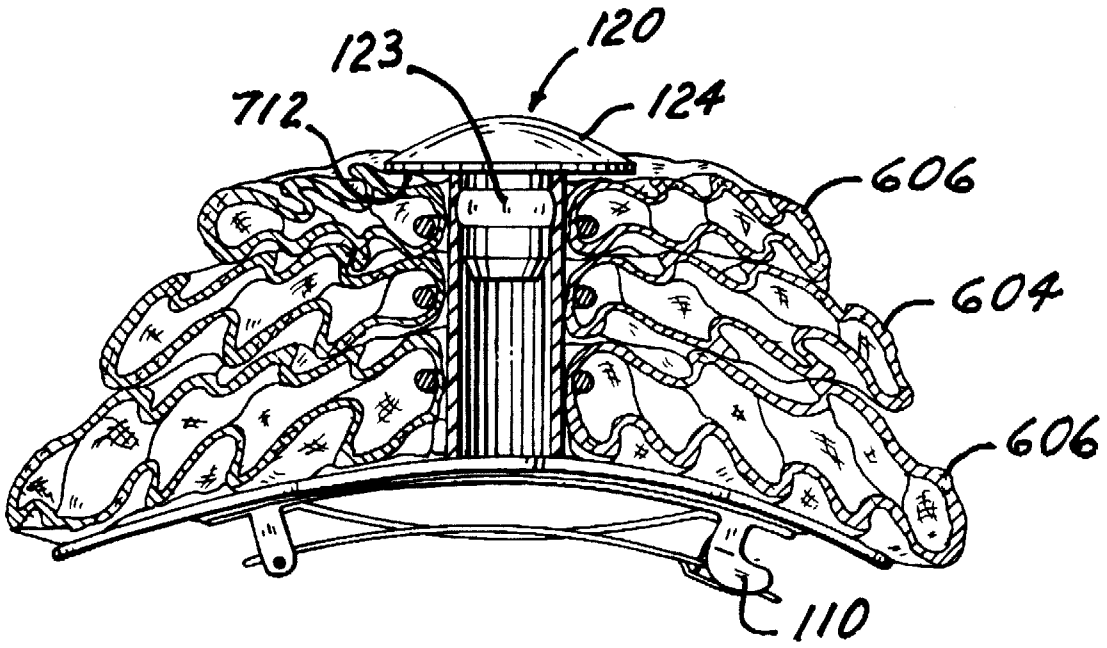
FIG. 7 is a sectional view taken along a line as shown in FIG. 6 and shows the detailed construction of the hair barrette assembly depicted in FIG. 6.

Referring to FIG. 7, it can be seen that ornamental appendages 602, 604, 606 may be formed of a compressible fabric material which may exert an opposing force against the inner surface 712 of ornamental button 124. This opposing force is disposed such that the ornamental head 124 would eventually be de-coupled from the barrette 110 when using a more conventional friction-fit coupling mechanism, allowing the ornamental appendages 602, 604, 606 to fall from the hair truss 608 and possibly become lost. However, use of a connecting means 126, such as shown in FIG. 1, having at least one rib 123 which is removably, but securely received by at least one recess 118 as described hereinbefore, counteracts this opposing force and securely retains the ornamental button assembly 120 in place, preventing detachment and possible loss of ornamental appendages 602,604,606.

It can also be seen that a hair barrette 110 or similar device is securely clamped to the truss of hair 608, which allows the wearer 620 to selectively remove the ornamental button 124 and/or the ornamental appendages 602, 604, 606, without requiring simultaneous and time consuming removal of the barrette 110.

Figure 8:
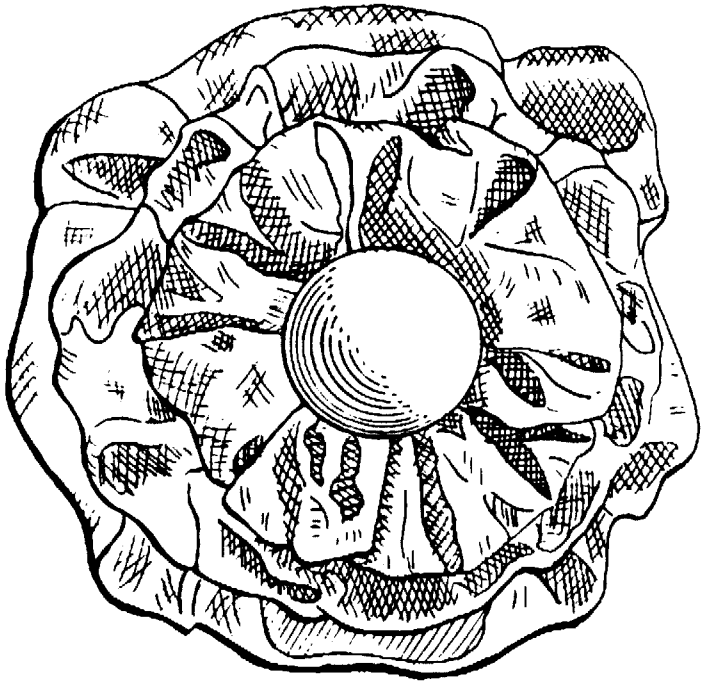
FIG. 8 is a top plan view of the hair barrette assembly shown in FIG. 6.
Figure 9:
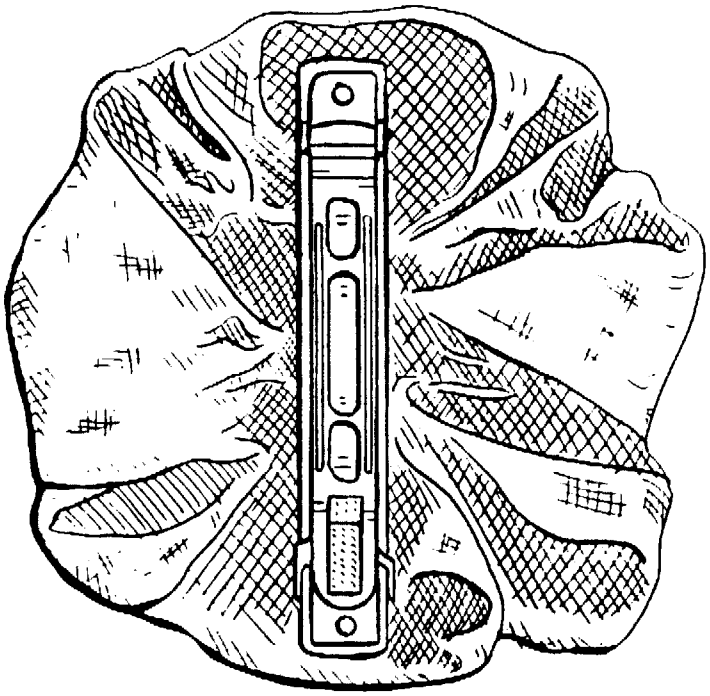
FIG. 9 is a bottom view of the hair barrette assembly shown in FIG. 6.

FIGS. 8 and 9 illustrate top and bottom views of the barrette assembly 600 depicted in FIGS. 6 and 7. FIG. 9 particularly shows that the hair clamp (barrette) 110 is completely concealed by the ornamental appendage 602 when attached to a wearer's truss of hair 608 as depicted in FIG. 6 and described above in detail.

From the foregoing detailed descriptions of particular embodiments of the invention, it will be apparent that a durable, flexible and easy to use hair barrette has been disclosed which is provided with the capability of rapidly, repetitively and selectively receiving, replacing and/or adding ornamental appendages substantially in perpetuity without functional deterioration of the mechanism for coupling the appendages to the hair barrette. The present invention overcomes the structural limitations of the connecting means disclosed by Edmark and further overcomes the tediously cumbersome disassembly limitations of the connecting means disclosed by Pabari. While the invention has been described above in connection with the particular embodiments and examples, one skilled in the art will appreciate that the invention is not necessarily so limited. It will thus be understood that numerous other embodiments, examples, uses, modifications of, and departures from the teachings disclosed may be made, without departing from the scope of the present invention as claimed herein.

I claim:

1. A hair barrette, comprising:

at least one compressible ornamental appendage having a retentive characteristic shape such that said at least one ornamental appendage returns substantially to said retentive characteristic shape subsequent to being compressed;

a hair clamp for clamping a tress of hair, said hair clamp having a reversible snap connector attached thereto such that said hair clamp and said reversible snap connector form a single unitary device thereof, said reversible snap connector adapted to removably receive said at least one compressible ornamental appendage; and a spigot comprising an ornamental head attached to a shaft adapted to removably engage said reversible snap connector such that said at least one compressible ornamental appendage is securely retained to said hair clamp, and such that selective attachment and detachment of said spigot to said reversible snap connector selectively allows rapid replacement and addition of said at least one compressible ornamental appendage to said hair clamp, said at least one compressible ornamental appendage being compressed upon said at least one of replacing and adding said at least one compressible ornamental appendage to said hair clamp, said spigot further adapted to variably engage said reversible snap connector such that said compression of said at least one compressible ornamental appendage can be selectively varied and set to accommodate said securely retained at least one compressible ornamental appendage.

2. The hair barrette as claimed in claim 1 wherein said reversible snap connector is a female receptacle and said spigot is a male plug.

3. The hair barrette as claimed in claim 2 wherein said spigot has a first end adapted to mate with said snap connector and has a second end having an ornamental button attached thereto such that said spigot and said ornamental button form a single unitary device.

4. The hair barrette as claimed in claim 3 wherein said snap connector is adapted to expand and contract upon insertion and removal of said spigot from said snap connector.

5. The hair barrette as claimed in claim 3 wherein said spigot is adapted to expand and contract upon insertion and removal of said spigot from said snap connector.

6. The hair barrette as claimed in claim 1 wherein said reversible snap connector is a male plug and said spigot is a female receptacle.

7. The hair barrette as claimed in claim 6 wherein said spigot has a first end adapted to mate with said snap connector and has a second end having an ornamental button attached thereto such that said spigot and said ornamental button form a single unitary device.

8. The hair barrette as claimed in claim 7 wherein said snap connector is adapted to expand and contract upon insertion and removal of said spigot from said snap connector.

9. The hair barrette as claimed in claim 7 wherein said spigot is adapted to expand and contract upon insertion and removal of said spigot from said snap connector.

10. A hair barrette comprising:

a hair clamp having a connecting means attached thereto such that said hair clamp and said connecting means form a single unitary device thereof, said connecting means adapted to removably and selectively receive a desired number of ornamental appendages; and a spigot including an ornamental head attached to a shaft removably coupled to said connecting means, said spigot adapted to variably engage said connecting means to selectively accommodate and secure said desired number of ornamental appendages to said hair barrette.

11. The hair barrette of claim 10 wherein said spigot has at least one protruding rib disposed thereon and further wherein said connecting means has a plurality of recesses, wherein each recess within said plurality of recesses is adapted to removably receive said at least one protruding rib.

12. The hair barrette of claim 10 wherein said connecting means has at least one protruding rib disposed thereon and further wherein said spigot has a plurality of recesses, wherein each recess within said plurality of recesses is adapted to removably receive said at least one protruding rib.

* * * * *